US006399548B1

(12) United States Patent
Vartanian et al.

(10) Patent No.: US 6,399,548 B1
(45) Date of Patent: Jun. 4, 2002

(54) FUNCTIONAL FLUIDS

(75) Inventors: Paul F. Vartanian, Oakland; Edward I. Aoyagi, Petaluma, both of CA (US); John E. Huron; Kenneth Lee McLeod, both of San Antonio, TX (US)

(73) Assignee: Chevron Oronite Company LLC, San Francisco, CA (US)

( * ) Notice: Subject to any disclaimer, the term of this patent is extended or adjusted under 35 U.S.C. 154(b) by 0 days.

(21) Appl. No.: 09/668,410

(22) Filed: Sep. 22, 2000

(51) Int. Cl.[7] ..... C10M 135/36
(52) U.S. Cl. ..... 508/273
(58) Field of Search ..... 508/272, 273

(56) References Cited

U.S. PATENT DOCUMENTS

| | | | | | |
|---|---|---|---|---|---|
| 3,929,652 | A | * | 12/1975 | Seni et al. | 508/237 |
| 4,210,544 | A | * | 7/1980 | Burton et al. | 508/273 |
| 4,617,136 | A | * | 10/1986 | Doe et al. | 508/273 |
| 5,427,700 | A | | 6/1995 | Stoffa | 252/18 |
| 5,490,946 | A | * | 2/1996 | Beltzer et al. | 508/273 |
| 5,874,390 | A | * | 2/1999 | Gong et al. | 508/273 |
| 6,251,840 | B1 | * | 6/2001 | Ward, Jr. et al. | 508/273 |

FOREIGN PATENT DOCUMENTS

| | | | |
|---|---|---|---|
| CA | 2 095 972 | 11/1993 | C10M/143/08 |
| EP | 0761805 A2 | 3/1997 | C10M/161/00 |
| EP | 0761805 A3 | 6/1997 | C10M/161/00 |

* cited by examiner

*Primary Examiner*—Jacqueline V. Howard
(74) *Attorney, Agent, or Firm*—Linda A. Stokley

(57) ABSTRACT

A method is provided for protecting a copper-containing metal from loss of copper when in contact with a functional fluid composition containing water, the method comprising employing in the functional fluid an oil-soluble dimercaptothiadiazole compound or derivative thereof in an amount sufficient to protect against loss of copper.

21 Claims, No Drawings

FUNCTIONAL FLUIDS

BACKGROUND OF THE INVENTION

Fluid used in hydraulic pumps occasionally fail to protect copper bearing parts from wear when water contamination is present. This can result in loss of copper from the copper-containing parts.

Copper passivators or copper corrosion inhibitors are known in the art. U.S. Pat. No. 5,427,700, issued Jun. 27, 1995 to Stoffa, discloses functional fluids comprising at least one triglyceride, at least one detergent-inhibitor additive, and at least one viscosity modifying additive and a synthetic oil. The fluid may also contain a metal passivator, such as a thiadiazole compound (see col. 43, line 6 et seq.). European Patent Application No. 761 805 A2, published Mar. 12, 1997, discloses a lubricating/functional fluid composition which is said to exhibit in use improved antiwear and antifoaming properties. The improvements are said to result from use of 2,5-dimercapto-1,3,4-thiadiazole and derivatives thereof together with silicone and/or fluorosilicone antifoam agents. These thiadiazole compounds and derivatives are said to be effective corrosion inhibitors for silver, copper, silver alloys and similar metals. An example of such compounds is said to be Hitec 4313, available commercially from Ethyl Corporation. Canadian Patent Application No. 2,095,972 discloses lubricants formed from blends composed of a major amount of mineral oil in the range of 75N to 200N, and minor amounts of poly-alpha-olefin oligomer formed from 1 -alkene of 6 to 20 carbon atoms and having a kinematic viscosity in the range of 2 to 7 cSt at 100° C., and acrylic polymeric viscosity index improver. The lubricants may contain a copper corrosion inhibitor such as 2,5-dimercapto- 1,3,4-thiadiazole or derivatives thereof It has been found that water contamination in a hydraulic fluid (e.g., water content at least 0.25 weight percent or at least 0.5 weight percent) can cause copper corrosion in, e.g., copper-containing bearing parts. If this corrosion occurs in, for example, a copper-containing (e.g., bronze) cylinder liner in a pump, it can lead to loss of flow in the pump.

It has now been discovered that when an oil-soluble dimercaptothiadiazole compound or derivative thereof is employed in functional fluids that contain water, copper containing metals in contact with the functional fluid are protected from copper loss. This discovery was quite surprising since other compounds known to be copper passivators or copper corrosion inhibitors do not perform nearly as well as the dimercaptothiadiazole compounds or derivatives thereof of this invention.

SUMMARY OF THE INVENTION

The present invention provides a method of protecting a copper-containing metal from loss of copper when in contact with a functional fluid composition containing water (e.g., at least 0.25 weight percent water or at least 0.5 weight percent water), said method comprising employing in said functional fluid an oil-soluble dimercaptothiadiazole compound or derivative thereof in an amount sufficient to protect against loss of copper.

The present invention also provides the above method of protecting a copper-containing metal wherein the oil-soluble dimercaptothiadiazole compound or derivative thereof has the formula:

(I)

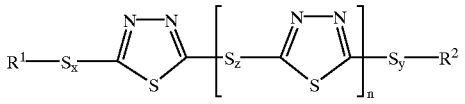

(II)

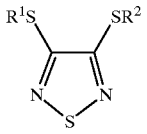

(III)

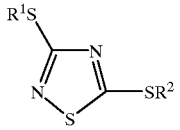

(IV)

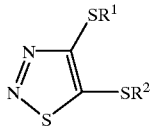

wherein $R^1$ and $R^2$ are hydrogen or hydrocarbyl, n is 0 or 1, x is 1 or 2, y is 1 or 2 and z is 1 or 2. In a preferred embodiment, $R^1$ and $R^2$ are $C_1$ to $C_{30}$ alkyl groups.

Preferably, the oil-soluble dimercaptothiadiazole compound or derivative thereof has the formula:

(I)

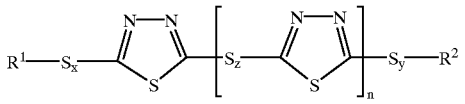

wherein $R^1$ and $R^2$ are hydrogen or hydrocarbyl, n is 0 or 1, x is 1 or 2, y is 1 or 2 and z is 1 or 2. More preferably, $R^1$ and $R^2$ are each $C_8$ alkyl groups, n is 0, and x and y are each 2.

Further provided by the present invention is the above method for protecting a copper-containing metal wherein the amount of oil-soluble dimercaptothiadiazole compound or derivative thereof employed is from 0.01 to 0.2 weight percent based on the weight of the functional fluid.

Also provided by the present invention is the above-described method of protecting a copper-containing metal wherein the functional fluid further comprises:

A. 0.5 to 6 weight percent detergent
B. 0.5 to 3 weight percent antiwear additive
C. 0.1 to 1.5 weight percent friction modifier
D. 0 to 1 weight percent seal swell component
E. 5 to 200 ppm foam inhibitor
F. 0.5 to 10 weight percent viscosity index improver
G. balance base oil.

In a preferred embodiment, the functional fluid used in the above method is a hydraulic fluid, preferably a tractor hydraulic fluid.

The present invention also provides a functional fluid composition comprising a base oil, 0.01 to 0.2 weight percent of a dimercaptothiadiazole compound or derivative thereof, and water (e.g., at least 0.25 weight percent water or at least 0.5 weight percent water).

Further provided by the present invention is the above-described functional fluid wherein the oil-soluble dimercaptothiadiazole compound or derivative thereof has the formula:

(I)

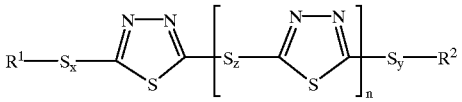

(II)

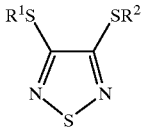

(III)

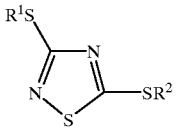

(IV)

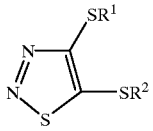

wherein $R^1$ and $R^2$ are hydrogen or hydrocarbyl, n is 0 or 1, x is 1 or 2, y is 1 or 2 and z is 1 or 2. In a preferred embodiment, $R^1$ and $R^2$ are $C_1$ to $C_{30}$ alkyl groups.

Preferably, the dimercaptothiadiazole compound or derivative thereof has the formula:

(I)

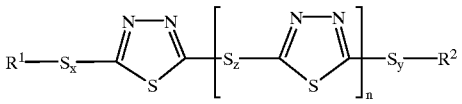

wherein $R^1$ and $R^2$ are hydrogen or hydrocarbyl, n is 0 or 1, x is 1 or 2, y is 1 or 2 and z is 1 or 2. More preferably, $R^1$ and $R^2$ are each $C_8$ alkyl groups, n is 0, and x and y are each 2.

The present invention further provides a functional fluid wherein the functional fluid further comprises:

A. 0.5 to 6 weight percent detergent

B. 0.5 to 3 weight percent antiwear additive

C. 0.1 to 1.5 weight percent friction modifier

D. 0 to 1 weight percent seal swell component

E. 5 to 200 ppm foam inhibitor

F. 0.5 to 10 weight percent viscosity index improver

G. balance base oil.

In a preferred embodiment, the functional fluid of the present invention is a hydraulic fluid, preferably a tractor hydraulic fluid.

DETAILED DESCRIPTION OF PREFERRED EMBODIMENTS

The present invention relates to functional fluids. These are fluids that are comprised of a major amount of a base oil and various additives. The functional fluids are used in, e.g., hydraulic systems and transmissions, as opposed to being used in the crankcase of an internal combustion engine.

The oil-soluble dimercaptothiadiazole compounds or derivatives thereof used in the present invention have the following formulas:

(I)

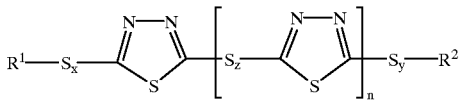

(II)

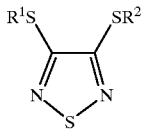

(III)

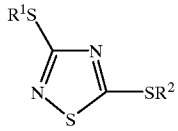

(IV)

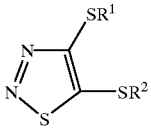

where $R^1$ and $R^2$ are hydrogen or hydrocarbyl, n is 0 or 1, x is 1 or 2, y is 1 or 2 and z is 1 or 2. Preferably, $R^1$ and $R^2$ are $C_1$ to $C_{30}$ alkyl groups. A preferred dimercaptothiadiazole derivative is that having formula I above where $R^1$ and $R^2$ are each $C_8$ alkyl, n is 0, and x and y are each 2. This compound is available commercially from Ethyl Corporation as Hitec 4313.

It has been found that the dimercaptothiadiazole compound or derivative thereof is not effective in preventing copper loss when used in amounts below 0.01 weight percent.

Typically, it is used in the functional fluid in amounts from 0.01 to 0.2 weight percent, based on the weight percent of the finished (fully formulated) functional fluid, not taking into account the amount of water present in the functional fluid.

The functional fluids useful in the present invention may also contain other additives, including, but not limited to, detergents, antiwear additives, friction modifiers, seal swell components, foam inhibitors and/or viscosity index improvers. The balance of the hydraulic fluid is base oil. These other additives and base oils are well known in the art, and are disclosed in aforementioned U.S. Pat. No. 5,427,700, European Patent Application No. 761 805, and Canadian Patent Application No. 2,095,972, each of which is incorporated by reference herein.

Base Oils

The base oils used in the functional fluids of this invention may be mineral oil or synthetic oils of viscosity suitable for use in functional fluids. The oils ordinarily have a viscosity of about 1300 cSt 0° F. to 24 cSt at 210° F. (99° C.). The oils may be derived from synthetic or natural sources. Mineral oil for use as the base oil in this invention includes paraffinic, naphthenic and other oils that are ordinarily used in functional fluids. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of both monocarboxylic acids and polycarboxylic acids, as well as monohydroxy alkanols and polyols. Typical examples are didodecyl adipate, pentaerythritol tetracaproate, di-2-ethylhexyl adipate, dilaurylsebacate and the like. Complex esters prepared from mixtures of mono and dicarboxylic acids and mono and dihydroxy alkanols can also be used. Blends of mineral oils with synthetic oils are also useful. For example, blends of 10% to 25% hydrogenated 1-trimer with 75% to 90% 150 SUS (100° F.) mineral oil gives a suitable base oil.

Detergents

Detergents useful in the functional fluids of this invention may be metallic detergents, such as overbased sulfurized alkylphenates, overbased sulfonates, and overbased salicylates.

Antiwear Additives

Useful antiwear agents include zinc dialkyldithiophosphate (Zn-DTP, primary alkyl type & secondary alkyl type), sulfurized oils, diphenyl sulfide, methyl trichlorostearate, chlorinated naphthalene, benzyl iodide, fluoroalkylpolysiloxane, and lead naphthenate.

Friction Modifiers

Useful friction modifiers include fatty alcohol, fatty acid, amine, borated ester, and other esters.

Seal Swell Components

Seal swell components (elastomer compatibility additives) that may be used in the functional fluids include dialkyl diesters such as dioctyl sebacate, aromatic hydrocarbons of suitable viscosity such as Panasol AN-3N, products such as Lubrizol 730, polyol esters such as Emery 2935, 2936 and 2939 esters from the Emery Group of Henkel Corporation and Hatco 2352, 2962,2925, 2938, 2939, 2970, 3178 and 4322 polyol esters from Hatco Corporation. Generally speaking, the most suitable diesters include the adipates, azelates, and sebacates of $C_8$ to $C_{13}$ alkanols (or mixtures thereof), and the phthalates of $C_4$ to $C_{13}$ alkanols (or mixtures thereof). Examples of such materials include the n-octyl, 2-ethylhexyl, isodecyl, and tridecyl diesters of adipic acid, azelaic acid, and sebacic acid, and the n-butyl, isobutyl, pentyl, hexyl, heptyl, octyl, nonyl, decyl, undecyl, dodecyl and tridecyl diesters of phthalic acid.

Foam Inhibitors

Foam inhibitors useful in the functional fluid include silicones, polyacrylates and surfactants. Various antifoam agents are described in Foam Control Agents by H. T. Kerner (Noyes Data Corporation, 1976, pages 125–176) which is incorporated herein by reference. Mixture of silicone-type antifoam agents such as the liquid dialkyl silicones with various other substances are also effective. Typical of such mixtures are silicones mixed with an acrylate polymer, silicones mixed with one or more amines, and silicones mixed with one or more amine carboxylates.

Viscosity Index Improvers

Viscosity index improvers may also be used in the functional fluids. These include polymethacrylate type polymers, ethylene-propylene copolymers, styrene-isoprene copolymers, hydrated styrene-isoprene copolymers, polyisobutylene, and dispersant type viscosity index improvers.

The functional fluids of this invention can be made by simply blending the various components into the base oil, Alternatively, all of the components except the water can be blended with the base oil, and the water will be introduced into the functional fluid via contamination during use, e.g., as a tractor hydraulic fluid.

The invention will be further illustrated by following examples, which set forth particularly advantageous embodiments. While the examples are provided to illustrate the present invention, they are not intended to limit it.

EXAMPLE 1

A functional fluid is prepared by blending the following components:

- 0.35 wt. % of Ca derived from Ca salt detergents
- 0.112 wt. % of P from anti-wear agents
- 0.44 wt. % of active friction modifier
- 0.7 wt. % of active seal swell agent
- 15 ppm of active foam inhibitor
- 6.85 wt. % Paratone 8022, a commercial viscosity index improver
- 0.025 wt. % dimercaptothiadiazole derivative of formula I where $R^1$ and $R^2$ are each $C_8$ alkyl, n is 0, and x and y are each 2 (available commercially from Ethyl Corporation as Hitec 4313)
- Balance Base Oil The resulting functional fluid was tested using ASTM D 130 Copper Corrosion Test and received a rating of 1A.

The functional fluid was also tested using John Deere standard test JDQ 84 Dynamic Corrosion Test for Transmission/Hydraulic Oils. In this test, the functional fluid is added to a Sundstrand 22-2132 pump, and the pump is operated for total of 225 hours. After 25 hours of operation, water is added to the functional fluid to provide water contamination of one per cent of the total oil volume in the test unit. Flow rates are measured and the functional fluid is analyzed at specified intervals. When the test is complete, components of the hydraulic pump are inspected.

The functional fluid of Example 1 had the following results in the JDQ 84 test:

End of test copper level: 8 ppm

End of test flow loss: −2%

End of test cylinder liner visual rating: 9.58

These results demonstrate that the functional fluid of this invention provides excellent protection from copper loss in the presence of water.

COMPARATIVE EXAMPLE A

For comparison purposes, a functional fluid was prepared as in Example 1, except that 0.025 weight percent of a triazole copper passivator (commercially available as Nalco VX 2326) was used instead of the dimercaptothiadiazole derivative. The resulting functional fluid was tested using the same procedures as in Example 1 with the following results:

ASTM D 130: rating 1A

JDQ 84

End of test copper level: 132 ppm

End of test flow loss: 2.4%

End of test cylinder liner visual rating: 3.46

These results were significantly worse than those of Example 1. Higher doses of the Nalco VX 2326 did not significantly improve performance.

What we claim is:

1. A method of protecting a copper-containing metal from loss of copper when in contact with a functional fluid composition comprising a major amount of base oil and containing water as a contaminant, said method comprising employing in said functional fluid an oil-soluble dimercaptothiadiazole compound or derivative thereof in an amount sufficient to protect against loss of copper.

2. The method of claim 1 wherein the dimercaptothiadiazole compound or derivative thereof has the formula:

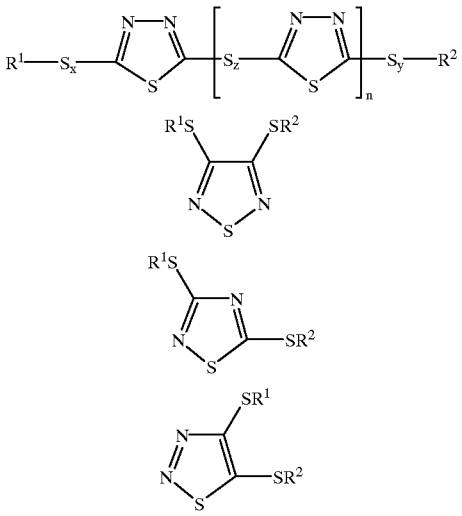

wherein $R^1$ and $R^2$ are hydrogen or hydrocarbyl, n is 0 or 1, x is 1 or 2, y is 1 or 2 and z is 1 or 2.

3. The method of claim 2 wherein $R^1$ and $R^2$ are $C_1$ to $C_{30}$ alkyl groups.

4. The method of claim 2 wherein the dimercaptothiadiazole compound or derivative thereof has the formula:

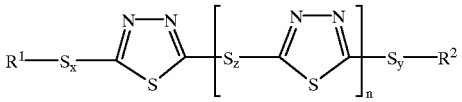

wherein $R^1$ and $R^2$ are hydrogen or hydrocarbyl, n is 0 or 1, x is 1 or 2, y is 1 or 2 and z is 1 or 2.

5. The method of claim 4 wherein $R^1$ and $R^2$ are each $C_8$ alkyl groups, n is 0 and x and y are each 2.

6. The method of claim 1 wherein the amount of thiadiazole compound employed is from 0.01 to 0.2 weight percent based on the weight of the functional fluid.

7. The method of claim 1 wherein the functional fluid further comprises:

A. 0.5 to 6 weight percent detergent

B. 0.5 to 3 weight percent antiwear additive

C. 0.1 to 1.5 weight percent friction modifier

D. 0 to 1 weight percent seal swell component

E. 5 to 200 ppm foam inhibitor

F. 0.5 to 10 weight percent viscosity index improver

G. balance base oil.

8. The method of claim 1 wherein the functional fluid is a hydraulic fluid.

9. The method of claim 8 wherein the hydraulic fluid is a tractor hydraulic fluid.

10. The method of claim 1 wherein the functional fluid contains at least 0.25 weight percent water.

11. The method of claim 1 wherein the functional fluid contains at least 0.5 weight percent water.

12. A functional fluid composition comprising a major amount of base oil, 0.01 to 0.2 weight percent of an oil-soluble dimercaptothiadiazole compound or derivative thereof, and water as a contaminant.

13. The functional fluid of claim 12 wherein the dimercaptothiadiazole compound or derivative thereof has the formula:

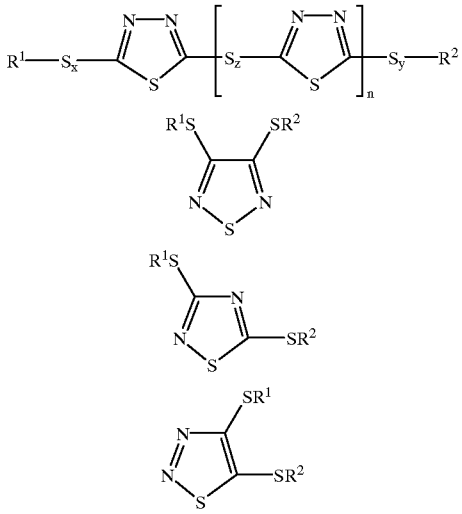

wherein $R^1$ and $R^2$ are hydrogen or hydrocarbyl, n is 0 or 1, x is 1 or 2, y is 1 or 2 and z is 1 or 2.

14. The functional fluid of claim 13 wherein $R^1$ and $R^2$ are $C_1$ to $C_{30}$ alkyl groups.

15. The functional fluid of claim 13 wherein the dimercaptothiadiazole compound or derivative thereof has the formula:

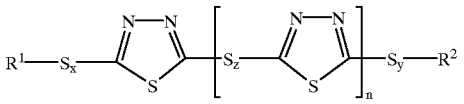

wherein $R^1$ and $R^2$ are hydrogen or hydrocarbyl, n is 0 or 1, x is 1 or 2, y is 1 or 2 and z is 1 or 2.

16. The functional fluid of claim 15 wherein $R^1$ and $R^2$ are each $C_8$ alkyl groups, n is 0 and x and y are each 2.

17. The functional fluid of claim 12 wherein the functional fluid further comprises:

A. 0.5 to 6 weight percent detergent

B. 0.5 to 3 weight percent antiwear additive

C. 0.1 to 1.5 weight percent friction modifier

D. 0 to 1 weight percent seal swell component

E. 5 to 200 ppm foam inhibitor

F. 0.5 to 10 weight percent viscosity index improver

G. balance base oil.

18. The functional fluid of claim 12 wherein the functional fluid is a hydraulic fluid.

19. The functional fluid of claim 18 wherein the hydraulic fluid is a tractor hydraulic fluid.

20. The functional fluid of claim 12 wherein the amount of water is at least 0.25 weight percent.

21. The functional fluid of claim 12 wherein the amount of water is at least 0.5 weight percent.

* * * * *